US005907968A

United States Patent [19]

Muschalik et al.

[11] Patent Number: 5,907,968

[45] Date of Patent: Jun. 1, 1999

[54] APPARATUS FOR STEPWISE TRANSVERSE CONVEYANCE OF PROFILES BETWEEN THE OUTLET OF A METAL EXTRUSION PRESS AND A STRETCHER LEVELLER

[75] Inventors: Uwe Muschalik, Duisburg; Josef Vetten, Neuss; Bernhard Zeuch, Ratingen; Alfred Steinmetz, Willich, all of Germany

[73] Assignee: SMS Eumuco GmbH, Leverkusen, Germany

[21] Appl. No.: 09/011,293

[22] PCT Filed: Aug. 3, 1996

[86] PCT No.: PCT/DE96/01452

§ 371 Date: Aug. 21, 1998

§ 102(e) Date: Aug. 21, 1998

[87] PCT Pub. No.: WO97/06902

PCT Pub. Date: Feb. 27, 1997

[30] Foreign Application Priority Data

Aug. 12, 1995 [EP] European Pat. Off. ..... 95112737
Sep. 27, 1995 [EP] European Pat. Off. ..... 95115199

[51] Int. Cl.[6] ..... B21C 35/00

[52] U.S. Cl. ..... 72/257; 72/256; 72/300; 198/463.2; 198/468.2

[58] Field of Search ..... 72/256, 257, 290, 72/295, 298, 300, 301, 302; 198/463.2, 463.3, 468.2; 414/746.8, 751; 212/312, 316, 319, 327

[56] References Cited

U.S. PATENT DOCUMENTS 1,441,354 1/1923 Jones .
4,050,278 9/1977 Asano et al. ..... 72/257

(List continued on next page.)

FOREIGN PATENT DOCUMENTS 40 19 974 1/1992 Germany .
60-118323 6/1985 Japan .

(List continued on next page.)

OTHER PUBLICATIONS

Schloemann–Rolling Mills•Hammers•Presses, Heat Treatment of Extruded Aluminum Sections at Extrusion Temperature, Hugo Beerens and Hugo Feldmann, 1971, pp. 1–7.

*Primary Examiner*—Joseph J. Hail, III
*Assistant Examiner*—Ed Tolan
*Attorney, Agent, or Firm*—DeLio & Peterson, LLC

[57] ABSTRACT

The invention relates to a device for the stepwise transverse transportation of sections, in particular groups of sections, from a longitudinal conveyor at the delivery end of a metal extrusion press to a first (8) and optionally a further (9) cooling station as far as a stretcher-leveller, in which each group of sections is gripped between clamps (I, II) at the ends of the sections during the said transverse transportation, in addition the clamps (I, II) accompanying a group of sections over one step with the clamps accompanying the next step and finally the clamps (12) of the stretcher-leveller arranged at the outside position [are] arranged alternately offset in the longitudinal direction of the sections at the distance of the depth of a clamping jaw, and the clamps (I, II) for one step remain closed until the clamps for a following step or the clamps (12) of the stretcher-leveller are closed, and in which the clamps which are open laterally in the transverse conveying direction are supported by vertical columns (18) vertically displaceable in guides (20) and the guides (20) in turn are guided horizontally by transverse rails (23, 24) and are arranged so as to be movable in the transverse conveying direction, and the transverse rails (24) displaceable in the longitudinal direction of the sections for compensating the lengths of the sections are supported by movable carriages guided by horizontal longitudinal rails. According to the invention the transverse rails guiding the clamps are constructed as bridges (23, 24) with trolleys (20) as clamp guides, the bridges spanning the transverse transportation along its length and being supported at their ends by longitudinal supports which are mounted on stands and arranged parallel to the delivery end of the press and of which at least the bridges (24) displaceable in the longitudinal direction of the sections are movable with bridge carriages on the longitudinal supports.

7 Claims, 6 Drawing Sheets

U.S. PATENT DOCUMENTS

| | | | |
|---|---|---|---|
| 4,873,857 | 10/1989 | Giancarlo | 72/257 |
| 4,975,018 | 12/1990 | Langenbacher et al. | 414/751 |
| 4,995,253 | 2/1991 | Groos et al. | 72/257 |
| 5,201,401 | 4/1993 | Haderer et al. | 198/463.3 |
| 5,467,630 | 11/1995 | Matsushima et al. | 72/257 |
| 5,560,240 | 10/1996 | Forster et al. | 72/257 |

FOREIGN PATENT DOCUMENTS

| | | |
|---|---|---|
| 974994 | 11/1964 | United Kingdom . |
| 1 333 310 | 10/1973 | United Kingdom . |

APPARATUS FOR STEPWISE TRANSVERSE CONVEYANCE OF PROFILES BETWEEN THE OUTLET OF A METAL EXTRUSION PRESS AND A STRETCHER LEVELLER

The metallic sections produced in an extrusion press are received by a delivery end. The delivery ends may be in the form of delivery tables in conjunction with removal devices (as known for example from EP 0 300 262 B1) or delivery conveyors (as known for example from DE 39 36 177 C2). The sections are conveyed individually or in groups in the operating cycle of the extrusion press transversely over a cooling bed to a stretcher-leveller and, after they have been levelled, to a longitudinal conveyor which conveys the sections to a saw or shears for cutting up into lengths suitable for commercial purposes and finally to a stacking device. At the delivery end behind the extrusion press the temperature of sections consisting of aluminium is in the range of from 450° to 500° C. for example. In order to be able to level the sections successfully by stretching, their temperature has to be lowered to below 80° C., for which purpose the cooling bed constructed in the form of a transverse conveyor is provided. The dwell period of the sections on the cooling bed and therefore the path of transverse conveying is reduced by fans which are arranged below the transverse conveyor and which generate an air flow directed from below against the sections to be cooled (Journal "*Aluminium*", Vol. 47 (1971) No. 9, pp. 545 to 549, in particular p. 547, DE-OS 2 015 664).

Whereas symmetrical sections cool without distortion, asymmetrical sections tend to become distorted, which is counteracted by the fact that the ends of rolled sections are gripped in clamps and the sections are held under tensile stress during the transverse conveying between the clamps, as is known from the U.S. Pat. No. 1,441,354 and DE-AS 1 216 657, in which case the tensile stress is automatically built up as shrinkage stress between the clamps or is applied by way of a piston-cylinder unit acting upon one of the clamps.

Extruded sections, on which particularly exacting demands are made with respect to their straightness, are levelled by stretching in a stretcher-leveller, referred to in brief as a stretching device, after cooling below 80° C. The introduction of asymmetrical sections, which tend to become distorted, into the clamping jaws of the stretcher-leveller gives rise to problems and stands in the way of automating the operating procedure. For this reason, asymmetrical sections or groups of asymmetrical sections which tend to become distorted are gripped at their ends on the delivery table or the delivery conveyor by clamps of a pair of clamps which follow during the transverse conveying and hold the sections with a longitudinal stressing to eliminate the distortion thereof entirely or substantially and insert the section or the closed group of sections into the clamps of the stretcher-leveller and which are released only after the clamps of the stretcher-leveller have gripped the section or sections. In this case, in order to achieve an adequate throughput, two or more pairs of clamps are provided, which have to be offset from one another in the longitudinal direction of the sections by the distance of at least the depth of a clamping jaw, in order to be capable of being moved in their intersecting operating areas, the clamps being offset alternately in order to keep short the end portions of the sections damaged by the gripping. In order that the clamps can be returned to their starting position from an end position in which they transfer a section or a group of sections to a further pair of clamps or to the clamps of the stretcher-leveller, the clamps are supported by vertical columns which are displaceable in guides, the guides being movable on horizontal rails in the transverse conveying direction. The sections are arranged with one end always in the line formed by the saw or shears at the delivery end of the press and the stationary part of the stretcher-leveller, so that the horizontal rails for guiding the clamps gripping the sections at the said ends can be arranged in a stationary manner. Like the second part of the stretcher-leveller, the clamps gripping the sections at the other ends have to be adjustable to the section length set in the respective pressing program and have to be additionally set to compensate the shrinkage associated with the cooling of the sections, for which purpose a carriage suspended so as to be displaceable in the longitudinal direction of the sections and guided on horizontal longitudinal rails is associated with each clamp and the transverse rail guiding it. In order to suspend the carriages a platform is required which supports the longitudinal rails and overhangs the delivery end of the extrusion press and the transverse conveyor as far as the region of the stretcher-leveller over a width corresponding to the length of the path of travel of the carriages and which is extremely disadvantageous not only because of its structural cost but also in particular since the accessibility of the transverse conveyor is gravely restricted from above by the overhanging platform.

The object of the invention is to improve - with respect to the structural cost and the accessibility of the transverse conveyor - a device for the transverse conveying in steps of sections, which is provided with clamps of pairs of clamps which alternately grip the sections or groups of sections during the transverse conveying from the delivery end behind the extrusion press as far as the stretcher-leveller, accompany them and hold them stretched by tensile stress. In order to achieve this object, the transverse rails guiding the clamps are constructed as bridges with trolleys as clamp guides, the bridges spanning the transverse transportation along its length and being supported at their ends by longitudinal supports which are mounted on stands and arranged parallel to the delivery end of the press and of which at least the bridges displaceable in the longitudinal direction of the sections for compensating the section lengths are movable with bridge carriages on the longitudinal supports.

Insofar as displaceability in the longitudinal direction of the sections is provided for a bridge for the sake of adjustability to a clamping line and in any case for the sake of displaceability in accordance with the respective section lengths, a synchronization control of the carriages of the bridges should be provided and, in addition, it should be provided that the bridge carriages can be fixed in the operating position with respect to the longitudinal supports. This further development of the invention results from the fact that the bridge supporting one of the pair of clamps for gripping a section or group of sections is displaceable in synchronism in its bridge carriages or the guide of one of the pair of clamps in longitudinal rails of a trolley associated with the bridge is displaceable in the longitudinal direction by at least the amount resulting from elongation and shrinkage of the clamped section or sections.

A simple energy supply is made possible by the fact that electro-mechanical linear lifting gears driven by rotating-field motors are provided for the clamp closure, for the vertical lifting of the clamp columns in their guides and optionally for the longitudinal movement of the bridges in their carriages and of the clamp guides in their trolleys.

During the transverse transportation the clamped section or the clamped group of sections also rests on the transverse conveyor belts, as a result of which, according to a further feature of the invention, the trolleys for the clamps are driven by dynamic servo motors in synchronism with the transverse conveyor belts.

Embodiments of the invention are illustrated in the drawings, in which

FIG. 1 is a plan view of an extrusion-press line with the transverse conveying direction according to the invention. The transverse conveying direction is shown in cut-away portions on a larger scale in FIG. 2 in a side view in the plane II—II in FIG. 1, while

FIG. 9 is a detail. A further modification is shown in

Figure 10:
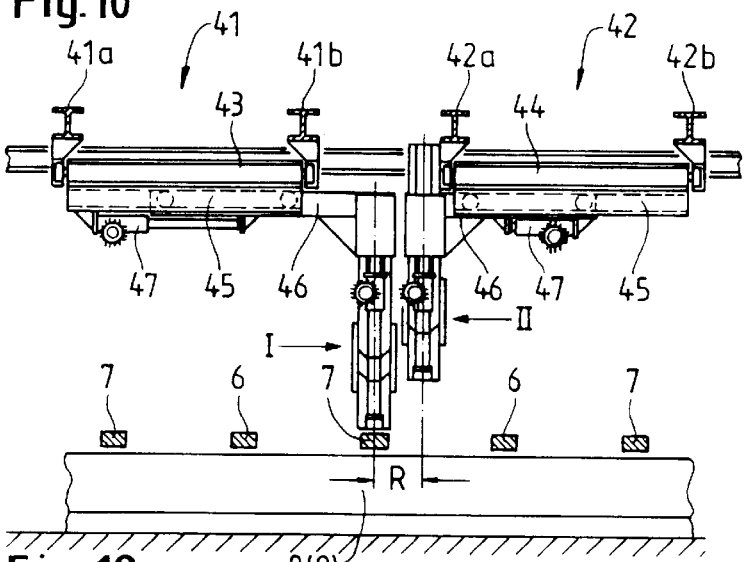

FIG. 10 in a longitudinal section, in

Figure 11:
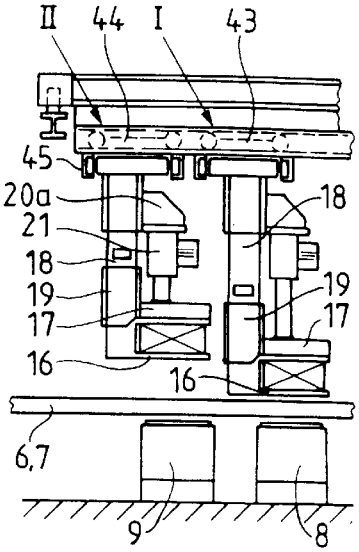

FIG. 11 in a cross-section, and in

Figure 12:
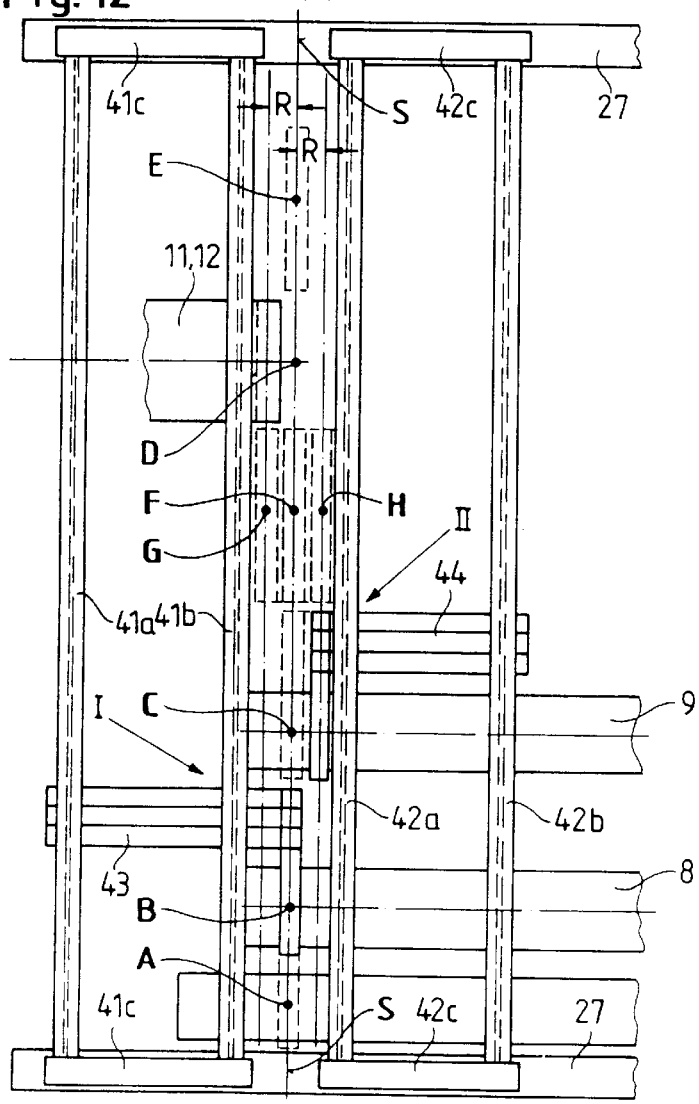

FIG. 12 in a plan view.

Figure 1:
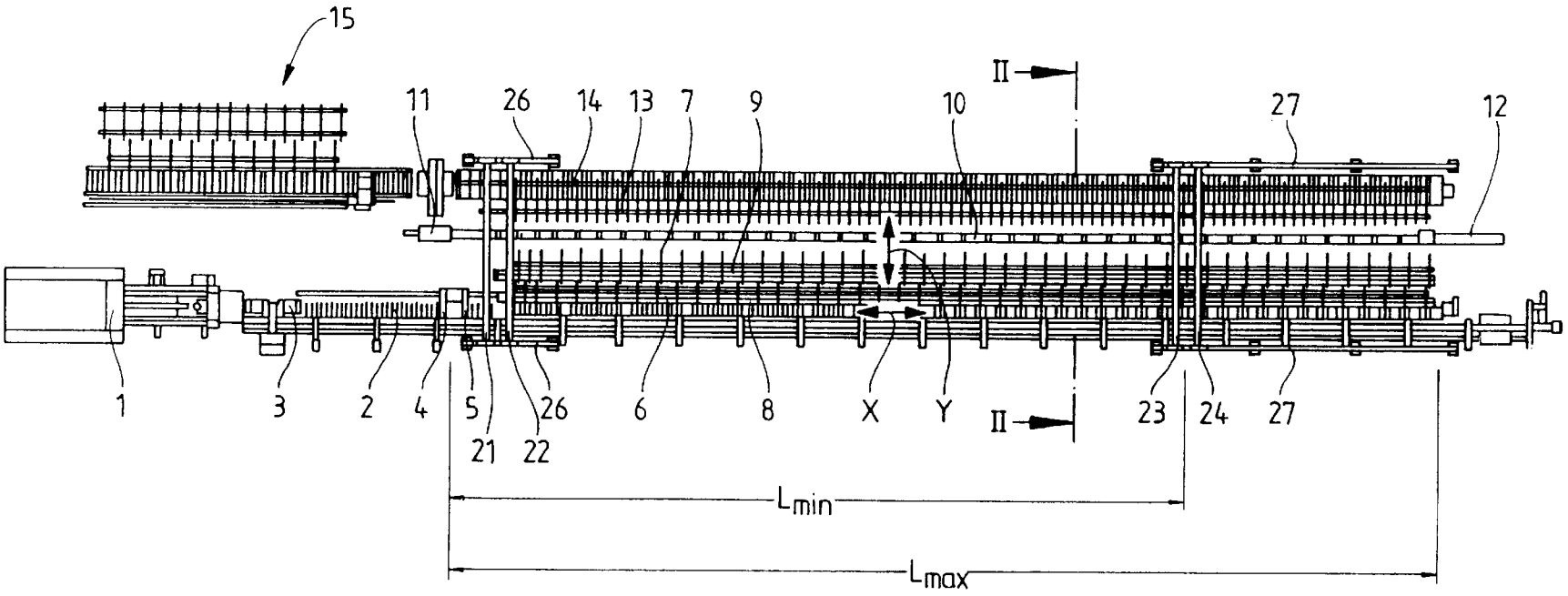

In the plan view of the extrusion-press line as shown in FIG. 1, the extrusion press is designated 1. A delivery conveyor 2 extends in a continuation of the axis of the extrusion press 1 in the longitudinal direction X, and has associated therewith a single-acting or double-acting removal device 3, of which possibly two grippers alternately grip and remove a section or a group of sections emerging from the extrusion press. (When the term "group of sections" is used in the following description, this can also stand for an individual section). A pair of shears 4 and a saw 5 are provided in order to cut the pressed-out group of sections to the specified length of a maximum of $L_{max}$ and minimum of $L_{min}$. The groups of sections cut to length are [conveyed] in steps from the delivery conveyor 2 to a first cooling zone 8 by transverse conveyors 6 and 7 intersecting in their operating area and controllable separately and they are deposited in a clock-timed cycle on a second cooling zone and are then introduced in the axis 10 of a stretching device which comprises a stationary clamping head 11 performing the stretching stroke and a counter head 12 adjustable to the specified length of the groups of sections. After the stretching-levelling the groups of sections are conveyed from the stretching device by a transverse conveyor 13 to a longitudinal conveyor 14 which takes them up and passes them on to the finishing station 15.

When sections are pressed which tend to become distorted during cooling, the groups of sections are gripped at their ends by clamps and are held during the cooling with longitudinal gripping which completely or largely eliminates the distortion. The clamps comprise a lower jaw 16 and an upper jaw 17 (cf FIG. 2), the lower jaw 16 being connected to a column 18 at a right angle, whereas the upper jaw 17 is connected to a sleeve 19 and is displaceable therewith along the column 18 in order to open and close the clamp. The column 18 is in turn vertically displaceable in a guide 20 which is constructed in the form of a trolley and is movable in the transverse direction along one of the bridges 22, 23, 24 and 25. The stroke of the column 18 in the guide 20 is limited at the bottom by a collar 18*a*. A linear lifting gear 21, which acts upon the upper jaw 17 in order to open and close the clamp, is supported on the guide 20 by way of a bracket 20*a*. When the clamp reaches its maximum opening width during the upward movement of the linear lifting gear 21, the sleeve 19 of the upper jaw 17 strikes against a stop 18*b* on the column 18, so that the said column 18 and with it also the lower jaw 16 is lifted to such an extent that it is situated above the upper edge of the transverse conveyors 6 and 7 by the amount of the maximum section height provided and can be moved away transversely over the sections.

The distance of the bridges 23/24 from the bridges 21/22 can be set in accordance with the section length provided. The bridges 21, 22, 23 and 24 span the entire transverse transportation from the removal device 3 to the longitudinal conveyor 14 with the first transverse conveyor 6, the second transverse conveyor 7 and the third transverse conveyor 13 and are supported by longitudinal supports 26 mounted on stands for the bridges 21 and 22 and longitudinal supports 27 mounted on stands for the bridges 23 and 24 and are movable along them with bridge carriages 28. The length of the longitudinal supports 27 is dimensioned in accordance with the difference between the largest and smallest section length provided. The longitudinal supports 26 are provided only for a short path of travel of the bridges 21 and 22 when the counter head 12 of the stretcher-leveller is not continuously adjustable, but at the interval of catches which is then compensated during the stroke of the clamping head 11 of the stretcher-leveller, otherwise the bridges 21 and 22 could be securely joined to the longitudinal supports 26.

Figure 8:
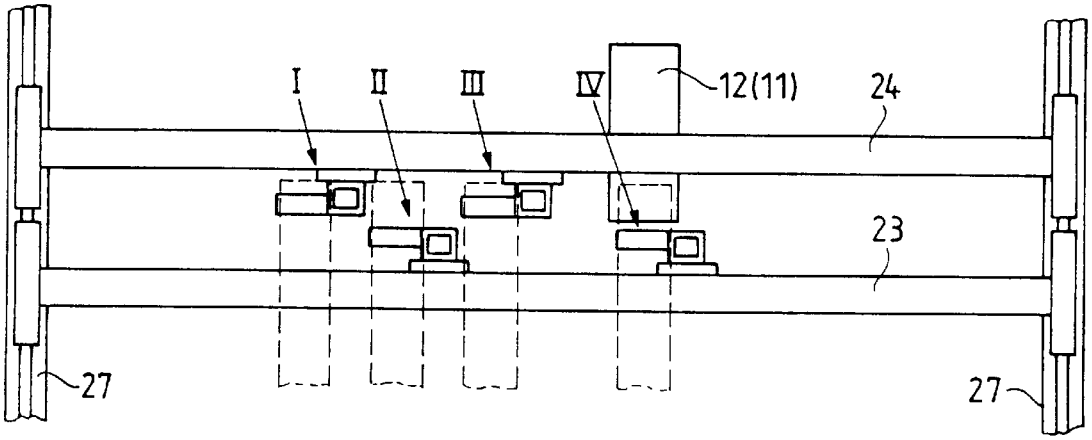
FIG. 8 is a plan view (corresponding to FIGS. 2 and 3) of a modification with three instead of two cooling zones.
Figure 9:
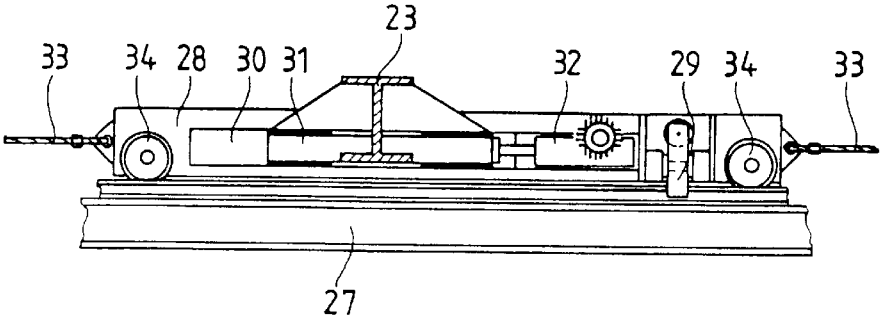

Because of the gripping of the group of sections in the pairs of clamps, tensile stress automatically builds up in the groups of sections as a result of the shrinkage which occurs during the cooling. In order to provide a tensile stress of specific, uniform magnitude from the beginning, however, at least one clamp of each pair of clamps is movable in the longitudinal direction of the gripped group of sections with a force corresponding to the desired tensile stress, for example by moving the bridge supporting the clamp. A bridge carriage suitable therefor is illustrated in FIG. 8. The bridge carriage 28 can be locked with respect to the longitudinal support 27 by means of a clamping device 29 and is provided with a slot 30 in which a sliding member 31 connected to the bridge 23 is movable in the longitudinal direction. A linear lifting gear 32 displaces the bridge 23 with the sliding member 31 thereof into the slot 30, this displacement taking place in synchronism in the two bridge carriages associated with one bridge and the tensile stress exerted upon the group of sections being applied in suitable portions by the linear lifting gears. The freedom of movement of the sliding members 31 in the slots 30 is dimensioned sufficiently for the amount which results from the shrinkage and elongation of the sections. For displacements of the bridge which exceed this, the bridge carriages are moved by way of cable lines 33 after the release of the clamping device 29 in synchronism with the two bridge carriages associated with one bridge and provided with wheels 34.

Figure 3:
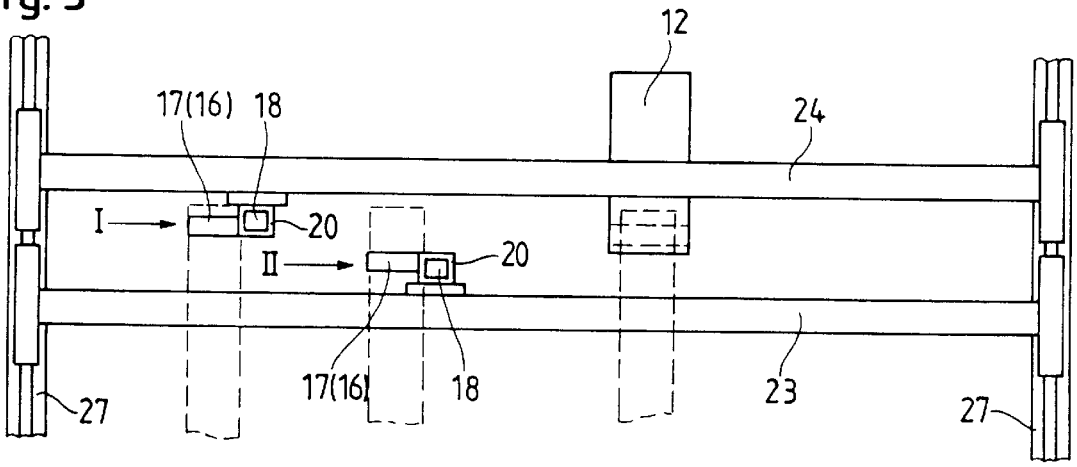
FIG. 3 is a cut-away portion of the outline in area II in FIG. 1 on the same scale.

As shown in FIG. 3, the clamps I and II are arranged on mutually opposite sides of the bridges 23 and 24, so that the jaws 16 and 17 of the clamp I are situated in the transverse direction with the jaws of the counter head 12 of the stretching device and the jaws 16 and 17 of the clamp II are situated at a slight distance outside this line, in order to keep as short as possible the end portions adversely affected by the gripping of the sections. In a corresponding manner, the counter clamps to the clamps I and II of the pairs of clamps are associated with the jaws of the stretching head of the stretching device and are arranged on the bridges 21 and 22.

Figure 4:
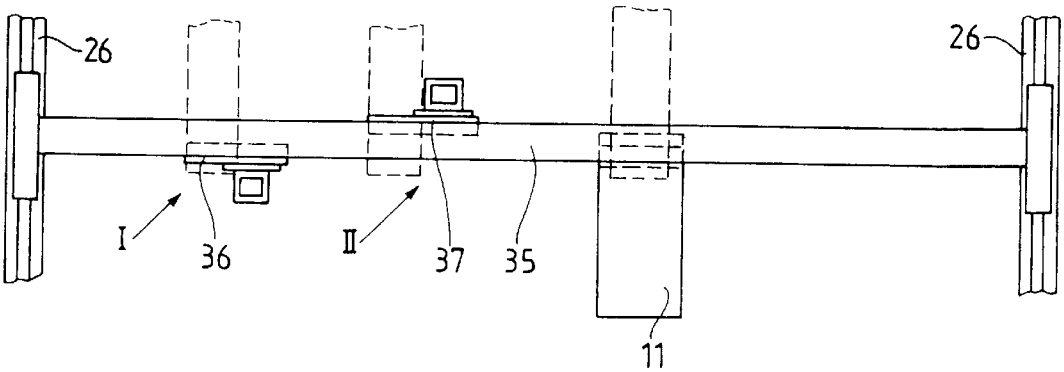
FIG. 4 shows a modification of the detail shown in FIG. 3.

FIG. 4 shows a modification using only a single bridge 35, which for example can take the place of the two bridges 22 and 23 and in particular are provided for supporting the clamps of the pairs of clamps arranged on a fixed gripping line or a gripping line variable only slightly in accordance with the lifting part of the clamping head 11 required for compensating the interval of the catches. The jaws 36 of the clamps I and the jaws 37 of the clamps II are offset with respect to one another below the bridge 35, in order to keep as short as possible the end portions of the sections which are adversely affected by the alternate gripping.

Figure 5A:
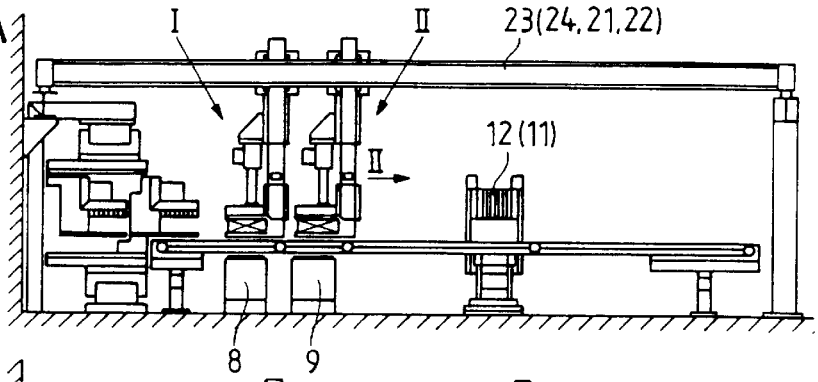
FIGS. 5A to 5E show the operating sequence on a smaller scale in a side view corresponding to FIG. 2.
Figure 5B:
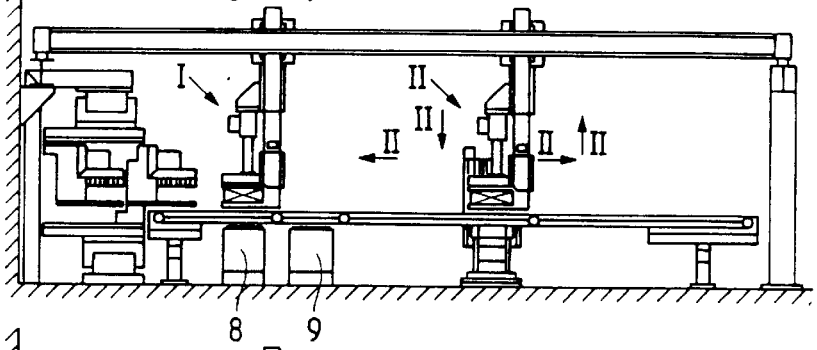
Figure 5C:
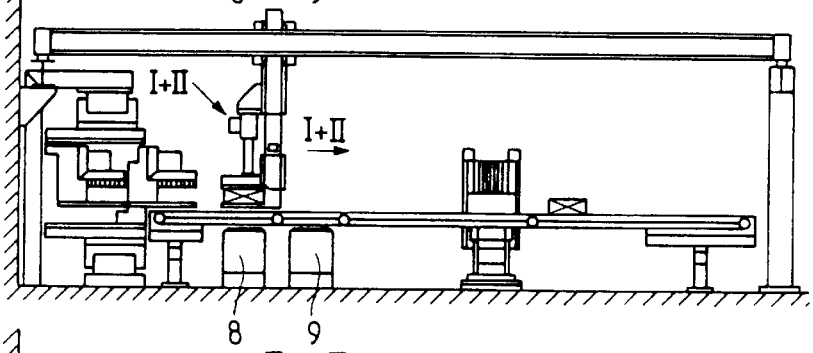
Figure 5D:
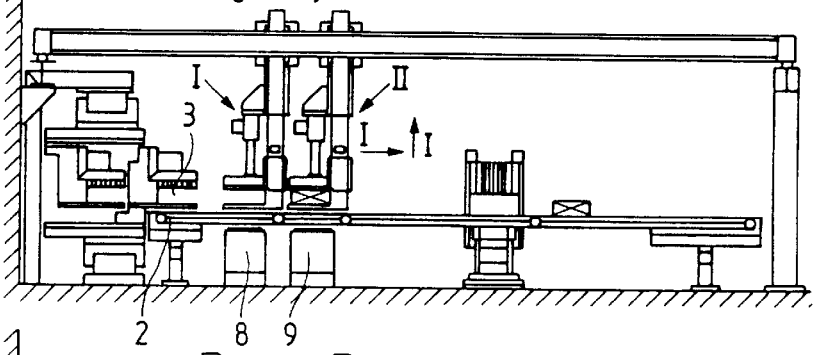
Figure 5E:
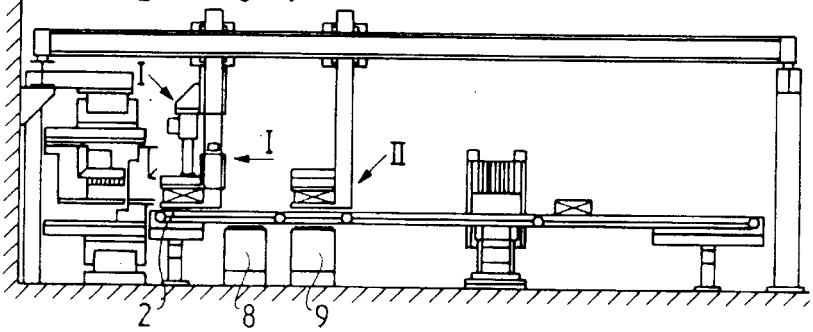

The operating sequence is illustrated in FIGS. 5A to 5E, in which the starting position selected in FIG. 5A is the moment at which a first group of sections gripped in the pair of clamps with the clamp I is situated above the cooling zone 8 and a second group of sections gripped in the pair of clamps with the clamp II is situated above the cooling zone 9. After sufficient cooling, while gripping is maintained the group of sections situated above the cooling zone 9 is conveyed transversely in the pairs of clamps with the clamp II as far as the axis 10 of the stretching device and is gripped there by the jaws of the clamping head 11 and the counter head 12, in order to be stretch-levelled there. As soon as the group of sections are gripped by the jaws of the clamping head 11 and the counter head 12 the clamp II and the counter clamp of the pair of clamps are released and the clamps II are moved in the transverse conveying direction (FIG. 5B), until the clamps II can be lifted vertically behind the group of sections, can be lowered back over the group of sections and in front of the group of sections again, and can be moved into the same position as the clamps I, where they then perform the task of clamping the group of sections present above the cooling zone 8 (FIG. 5C). The clamps I can then be released. The clamps I and II are jointly moved transversely, until the clamps II with the first group of sections are stopped above the cooling zone 9, whereas the opened clamps I are moved further transversely, are lifted behind the first group of sections, are moved back above them, and lowered again (FIG. 5D) and are then moved into the region of the delivery conveyor 2 in order to receive a following group of sections, as soon as the group of sections is removed by the removal device 3 (FIG. 5E). This group of sections, gripped by the clamps I, is then moved above the cooling zone 8, thereby ending one operating cycle.

Figure 2:
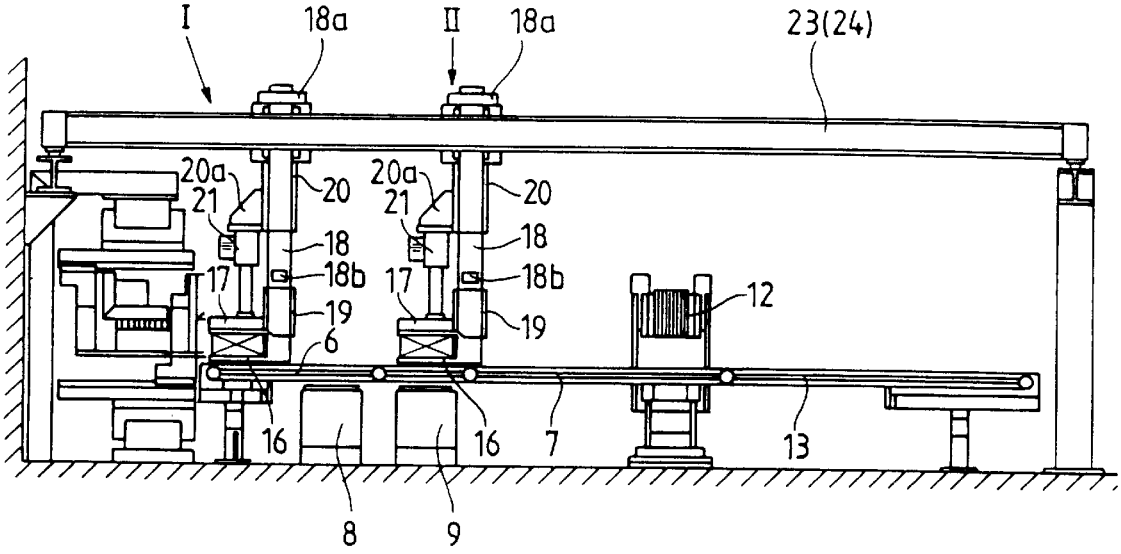
Figure 6A:
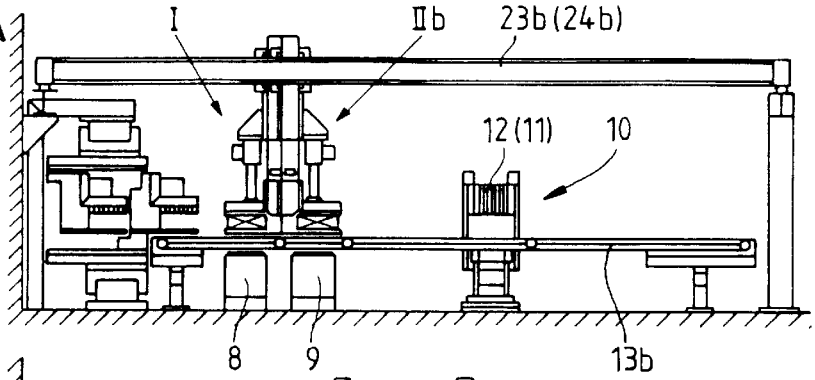
FIGS. 6A to 6E show the operating sequence for a modified embodiment.
Figure 6B:
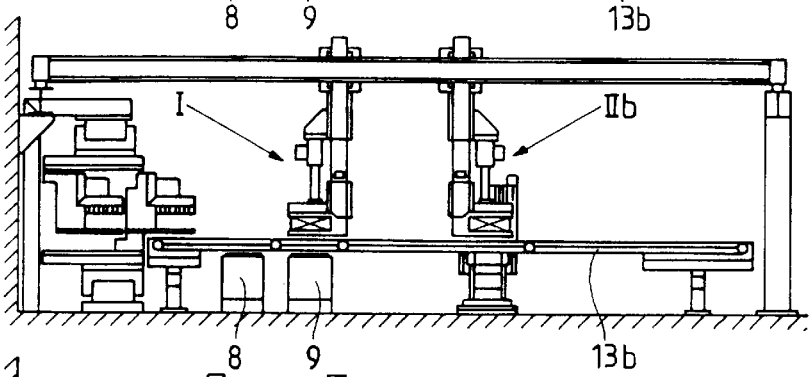
Figure 6C:
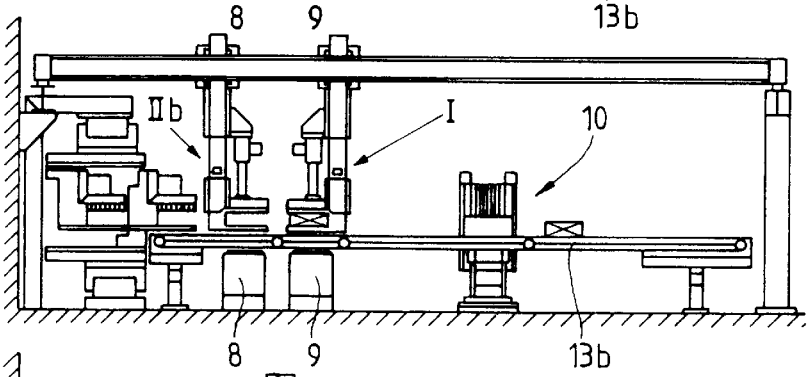
Figure 6D:
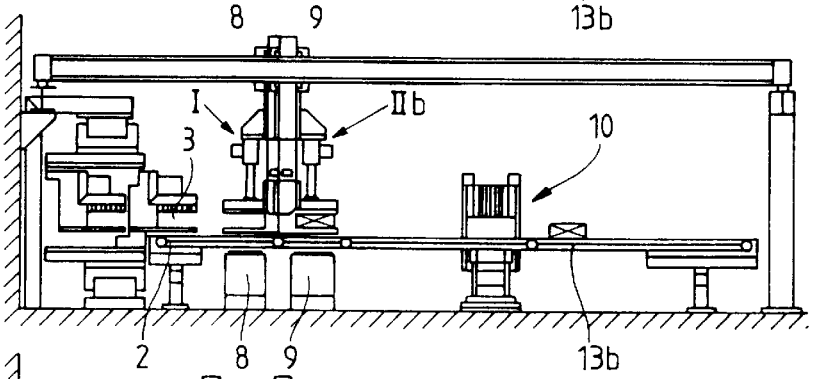
Figure 6E:
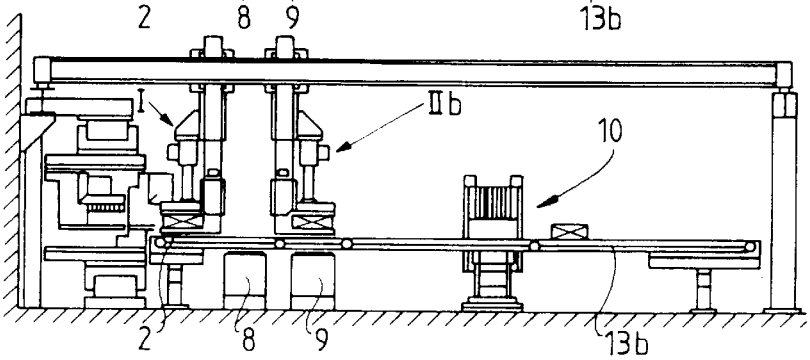

A further modification and an operating sequence which can be performed with this modified embodiment are illustrated in FIGS. 6A to 6E. The modification lies in the fact that the clamps IIb of the pair of clamps transferring a group of sections to the clamps of the stretcher-leveller 10 are opened in the transverse conveying direction instead of contrary to the transverse conveying direction (as in the embodiment as shown in FIGS. 2 and 3), the advantage of this arrangement being that the clamps IIb can be extended contrary to the transverse conveying direction with respect to the group of sections gripped in the stretcher-leveller 10 and the transverse conveyor 13*b* can be stopped in a manner shorter by the amount required for extending the clamps II in the embodiment according to FIGS. 2 and 3. The bridges 23*b*, 24*b* are also shortened by the same amount. The sequence of operation is as follows: In the starting position illustrated in FIG. 6A one respective group of sections is present above the cooling zone 8 and the cooling zone 9 in each case. After a sufficient dwell period in the operating cycle of the extrusion press, one group of sections is inserted by the pair of clamps IIb from the cooling zone 9 into the gripping jaws of the stretcher-leveller 10 with its gripping head 11 and counter gripping head 12 and it is gripped by them, while at the same time the pair of clamps I together with group of sections gripped thereby is moved from cooling zone 8 to cooling zone 9, as illustrated in FIG. 6B. After the clamps IIb are opened they are extended contrary to the transverse conveying direction, are lifted vertically, and moved away over the group of sections gripped by the clamps I, are lowered in front of them (FIG. 6C) and are moved so far forward in the transverse conveying direction that they can receive the group of sections present above the cooling zone 9 and can grip them. The clamps I are then opened and are extended in the transverse conveying direction, are lifted vertically, are moved contrary to the transverse conveying direction to in front of the group of sections present above the cooling zone 9 and are lowered there. As soon as the removal device 3 has made a new group of sections available on the delivery conveyor 2 (FIG. 6D), the clamps I are moved contrary to the transverse conveying direction to receive the group of sections on the delivery conveyor 2, as illustrated in FIG. 6E. This group of sections is then moved by the clamps I above the cooling zone 8, thereby ending one operating cycle.

Figure 7:
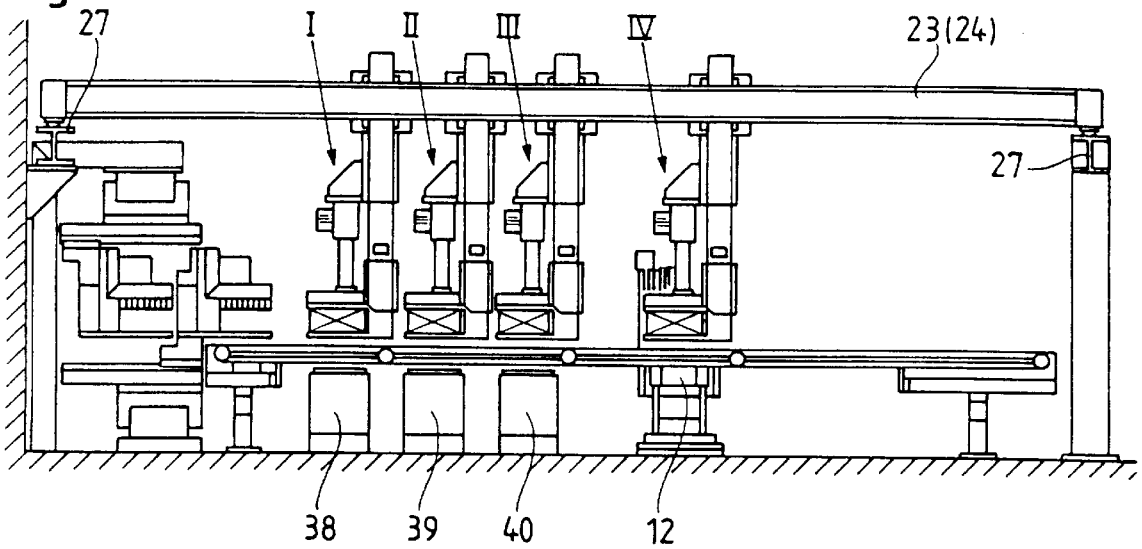
FIG. 7 is a side view.

FIGS. 7 and 8 show a modification with respect to the number of cooling zones to three, 38, 39 and 40, instead of two in the embodiment as shown in FIGS. 2 and 3. In order to transfer the groups of sections with constant gripping from the delivery conveyor 2 as far as the axis 10 of the stretching device, four clamps I, II, III and IV and pairs of clamps are required. The clamps I and III are in alignment with the clamps of the counter head 12 or in the part (not shown) of the gripping head 11, whereas the clamps II and IV with their jaws in alignment are arranged offset in the longitudinal direction by slightly more than the depth of the jaws. In principle, the operating sequence resembles that described in FIGS. 5A to 5E. Starting from the situation which is illustrated in FIGS. 6 and 7 and in which a group of sections is moved into the stretching device, the clamps IV are released, are moved away over the group of sections into the same position as the clamps III, where they are closed. The clamps III are now released and are moved away over the group of sections into the same position as the clamps II and are closed there. As a result, the clamps II are now released and are moved away over the group of sections into the same position as the clamps I and are closed there. Finally, the clamps I are released and moved away over the group of sections in order to receive a new group of sections when this new group of sections has run up onto the delivery conveyor. As soon as the group of sections levelled in the stretching device is removed from the stretching device by the transverse conveyor 13, the clamps I, II, III and IV together with the groups of sections gripped thereby are displaced transversely into the following position, so that a further operating cycle can begin.

In the embodiment illustrated in FIGS. 10, 11 and 12, the bridges 41 and 42 are each formed by two webs 41*a*, 41*b* and 42*a*, 42*b*, the webs 41*a*, 41*b* being joined by bridge carriages 41*c* and the webs 42*a*, 42*b* by bridge carriages 42*c*. A trolley 43 is movable in the transverse direction between the webs 41*a* and 41*b* of the bridge 41 and a trolley 44 is movable in the transverse direction between the webs 42*a* and 42*b* of the bridge 42, namely in synchronism with the movement of the transverse conveyors 6 and 7, by which the groups of sections are supported in addition to the gripping in the clamps. The trolleys 43 and 44 are provided with rails 45 which are arranged in the longitudinal direction and in which guides 46 are displaceable, which are otherwise formed like the guides 20 in the embodiment as shown in FIGS. 2 and 3, to which reference is made for the corresponding description. The guides 46 are displaced in the rails 45 by linear lifting gears 47, by which the groups of sections are held under the required tensile force. The bridge carriages 41*c*, 42*c* are movable by way of cable lines and can be locked with respect to the longitudinal supports 27 by means of clamping devices.

A particular advantage is afforded by the embodiment according to FIGS. 10, 11 and 12 by a dimension of the rails 45 and the path of travel of the guides 46 in the rails 20 which allows the clamps I and II to move longitudinally from a position in alignment in the transverse direction on the line S—which corresponds to the position of the clamps when the group of sections is transferred to the clamps of the stretching device—in opposed directions by an amount which corresponds to the internal dimension R between the intersecting clamps I and II in addition to the amount resulting from the shrinkage and stretching of the sections. In this way, it is possible to convey the groups of sections with constant gripping from the delivery conveyor 2 into the stretching device, in which case the clamps I and II move on the line S adapted for transferring the groups of sections to the stretching device and in the area of intersection the returning clamp can yield through the movement by the internal dimension R of the moving clamp, so as then to return to the line S of the moving clamps. In this way, starting from position A, the clamp I with a gripped group of sections passes through positions B and C above the cooling zones 8 and 9 and arrives at position D in which the group of sections is transferred to the clamps of the stretching device. The clamp I is then released, is moved into position E, is raised and is moved into position F over the group of sections. There the longitudinal displacement by the internal dimension R into position G takes place, from where it returns past the clamp II into the starting position. Starting from position A, the clamp II likewise passes through positions B, C and D, where the group of sections held by it is transferred to the clamps of the stretching device. After the clamp II is released it likewise moves into position E, is lifted and moves away over the group of sections into position F. There the longitudinal displacement by the internal dimension R into position H takes place, from where it returns past the clamp I into the starting position.

We claim:

1. In a device for the stepwise transverse transportation of at least one section from a longitudinal conveyor at a delivery end of a metal extrusion press to at least one cooling station and to a stretcher-leveller, comprising:

clamps between which the at least one section is gripped at its ends during the stepwise transverse transportation and at the stretcher-leveller;

the clamps for successive steps of the stepwise transverse transportation and the clamps of the stretcher-leveller being arranged alternately offset in a longitudinal direction of the at least one section at a distance of a depth of a clamp jaw;

the clamps for each step remain closed until the clamps for a following step or the clamps of the stretcher-leveller are closed;

transverse rails and guides guided horizontally by the transverse rails, said rails having means for moving the guides in a transverse transportation direction, and vertical columns which are vertically displaceable in the guides and which support the clamps which are open in the transverse transportation direction, whereby after the clamps have been raised at an end position of their step they can, by horizontal transverse movement and vertical movement, be lifted over the at least one section and retracted to a starting position for receiving a following at least one section; and horizontal longitudinal rails and longitudinally movable carriages which are guided by the longitudinal rails and which support the transverse rails displaceably in the longitudinal direction of the at least one section for adjusting to a length of the at least one section;

the improvement comprising:

the transverse rails are constructed as bridges and the guides are constructed as trolleys, the bridges spanning the transverse transportation along its length and being supported at their ends by longitudinal supports which are mounted on stands and arranged parallel to the delivery end of the press, and at least the bridges displaceable in the longitudinal direction of the at least one section are movable with bridge carriages on the longitudinal supports.

2. The device according to claim 1, wherein two bridge carriages movable in synchronism are fixed with respect to the longitudinal supports, and each bridge is displaceable in its carriage in synchronism in the longitudinal direction by at least the amount resulting from elongation and shrinkage of the at least one clamped section.

3. The device according to claim 1, wherein two bridge carriages movable in synchronism can be fixed with respect to the longitudinal supports, and each bridge is provided with at least one trolley carrying longitudinal rails along which a clamp is displaceable with a clamp guide in the longitudinal direction by at least the amount resulting from elongation and shrinkage of the at least one clamped section.

4. The device according to claim 1, wherein the clamps of a pair of clamps transferring the at least one section in the last step to the clamps of stretcher-leveller are opposed, being opened laterally in the transverse direction.

5. The device according to claim 1, further comprising electro-mechanical linear lifting gears driven by rotating-field motors for the clamp closure, for vertical lifting of the clamp columns in their guides and optionally for longitudinal movement of the bridges in their carriages and of the clamp guides in their trolleys.

6. The device according to claim 1, further comprising dynamic servo motors for driving the trolleys for the clamps synchronously with the speed of transverse conveyor belts for transporting the at least one section.

7. The device according to claim 1, including two bridges, trolleys movable transversely on the bridges, clamp guides mounted on the trolleys in a space between the bridges and movable transversely with the trolleys and longitudinally with respect to the trolleys, wherein the distance of the bridges and the longitudinal path of travel of the clamp guide from the trolley is dimensioned such that each clamp guide is moved from an advanced position, by an internal dimension between intersecting clamps and clamp guides onto the associated bridge, so that a group of sections received from the delivery conveyor by a clamp are moved in a clamping head and a counter head while maintaining the clamping in the said clamp until it is transferred by the clamps of the stretching device.

* * * * *